United States Patent [19]

Petersen

[11] 3,974,949

[45] Aug. 17, 1976

[54] SHEET PREFEEDER FORMING AN OVERHEAD STOCK LOOP TO THE INPUT OF AN INCREMENTAL FEEDER FOR A CUPPING PRESS

[75] Inventor: Paul S. Petersen, Minnetonka, Minn.

[73] Assignee: MTS Systems Corporation, Eden Prairie, Minn.

[22] Filed: Jan. 28, 1975

[21] Appl. No.: 544,691

[52] U.S. Cl. ..... 226/42; 226/44; 226/117

[51] Int. Cl.[2] ..... B65H 25/04

[58] Field of Search ..... 226/25, 42, 43, 44, 226/114, 117, 118

[56] References Cited

UNITED STATES PATENTS

| | | | |
|---|---|---|---|
| 2,345,656 | 4/1944 | Calleson | 226/44 X |
| 3,206,961 | 9/1965 | Bailey | 226/44 X |
| 3,322,315 | 5/1967 | Eberlin | 226/44 |
| 3,385,491 | 5/1968 | Helms | 226/25 |
| 3,570,080 | 3/1971 | Holm | 226/44 |
| 3,680,753 | 8/1972 | Shaw-Stewart | 226/44 X |
| 3,784,123 | 1/1974 | Lewis | 226/44 X |

*Primary Examiner*—Richard A. Schacher
*Attorney, Agent, or Firm*—Dugger, Johnson & Westman

[57] ABSTRACT

A prefeeder drive for a sheet of material positioned on the input side of a standard incremental type sheet feeder for a forming press and which has drive rolls that move a sheet of material through a lubrication bath and toward the press. The sheet is driven to form an upright or overhead loop prior to entry of the sheet into the main, incremental feeder. The drive comprises a pair of rolls which are driven in response to a feedback control system sensing the size of the overhead loop so that the loop size is maintained within a desired range to insure satisfactory feeding of the sheet material into the main feeder and thence into the press. The overhead or free standing loop substantially reduces the inertia of the material that the main feeder has to overcome when feeding an increment of sheet stock into the press, and thus makes the feeding of the material more reliable with less likelihood of misfeeds.

8 Claims, 3 Drawing Figures

FIG. 1
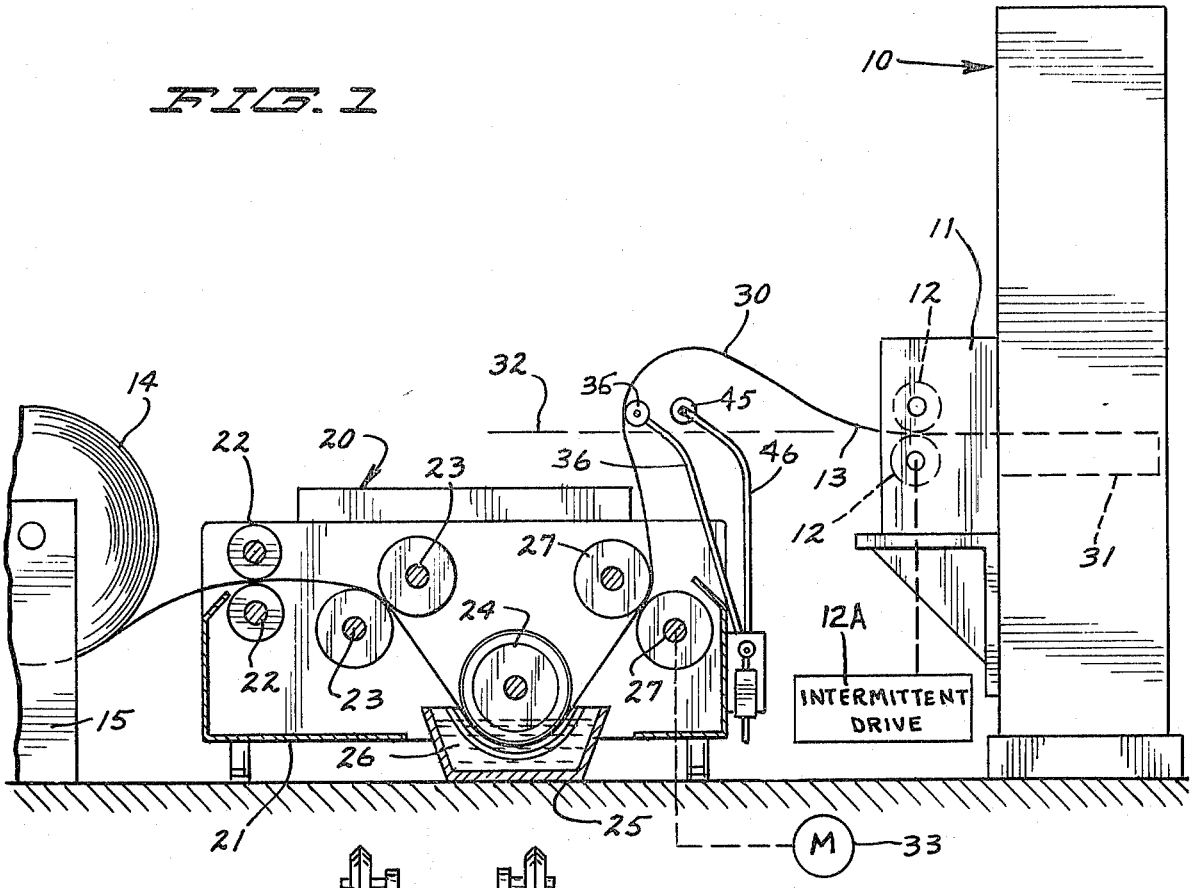
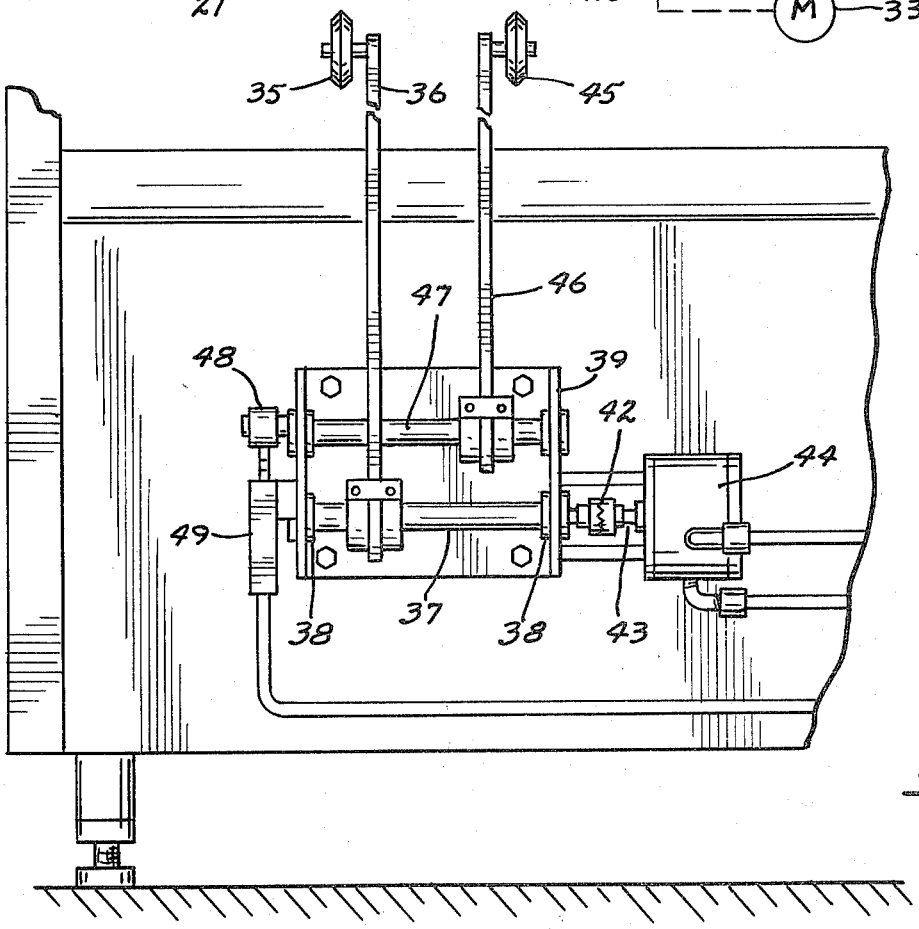
FIG. 2

SHEET PREFEEDER FORMING AN OVERHEAD STOCK LOOP TO THE INPUT OF AN INCREMENTAL FEEDER FOR A CUPPING PRESS

BACKGROUND OF THE INVENTION

1. Field of the Invention

The present invention relates to feeding devices for sheet stock used in presses, and more particularly to a feeding device forming an overhead stock loop ahead of the conventional incremental feeder.

2. Prior Art

In the prior art, various types of stock feeders that feed sheet stock such as steel, incrementally into punch presses are known. Further, this material is usually passed through a lubricator that applies a film of lubricant on the sheet of material before the material passes into the incremental feeder. The lubricators generally have drive rollers for moving the sheet, while the incremental feeders are usually either reciprocating drive or "start-stop" roll feeders. In other words, a continuous feed into the press is not made, but an increment or desired length of material is fed into the press after each press stroke so that new material is positioned in the die set for the next stroke of the press.

In the usual set up, the material is allowed to hang downwardly from the output of the prefeeder, such as the lubricator, and then it is raised upwardly to the incremental feeder. The material forms generally a catenary curve so that when the incremental feeder feeds the material, the entire hanging loop has to be lifted. This creates a substantial inertia that must be overcome and this of course makes it more difficult to feed the material rapidly and precisely.

SUMMARY OF THE INVENTION

The present invention relates to means for forming an overhead or upright stock loop ahead of an incremental feeder for a cupping press. The means for forming this loop includes a prefeeder drive that removes material from a supply roll or similar stock supply, and drives or moves the sheet to form the overhead loop. The loop is formed above the general plane of the material as it is fed through the main feeder, which plane lies along the feed line of the die set. The overhead loop substantially reduces the inertia as material is incrementally fed by the main feeder.

Feedback means to sense the size of the loop and to prove a control signal to the prefeeder drive so that the loop is maintained within prescribed limits during operation are provided.

In the form shown, the prefeeder drive is a lubricator assembly wherein the sheet of stock is moved through a lubricating bath. The lubricator has powered drive members for the sheet, and these drive members are controlled by the feedback sensor to insure that the loop on the output side of the lubricator is maintained within prescribed limits for satisfactory operation of the main feeder that subsequently moves the sheet of material incrementally into a press.

In the form of the invention shown, the lubricator forming the overhead or loop is used with an incremental feeder and press for forming deep drawn members. The main feeder can be of any desired type, such as a reciprocating incremental feeder or a roller feeder that starts and stops the sheet at the desired times for feeding an increment of material into the press between press strokes.

The formation of the overhead loop substantially reduces the inertia of the material and makes it feasible to provide higher speed feeding and also helps to make reciprocating feeders feasible. With lower inertia, the gripping members of a reciprocating feeder are less likely to tear the sheet or to slip.

BRIEF DESCRIPTION OF THE DRAWINGS

FIG. 1 is a part schematic side elevational view of a typical feeding arrangement used with a reciprocating punch press, including a prefeeder comprising a lubricator forming a free standing overhead stock loop;

FIG. 2 is a fragmentary end view of the prefeeder, showing a feedback control mechanism.

DESCRIPTION OF THE PREFERRED EMBODIMENT

Figure 3:
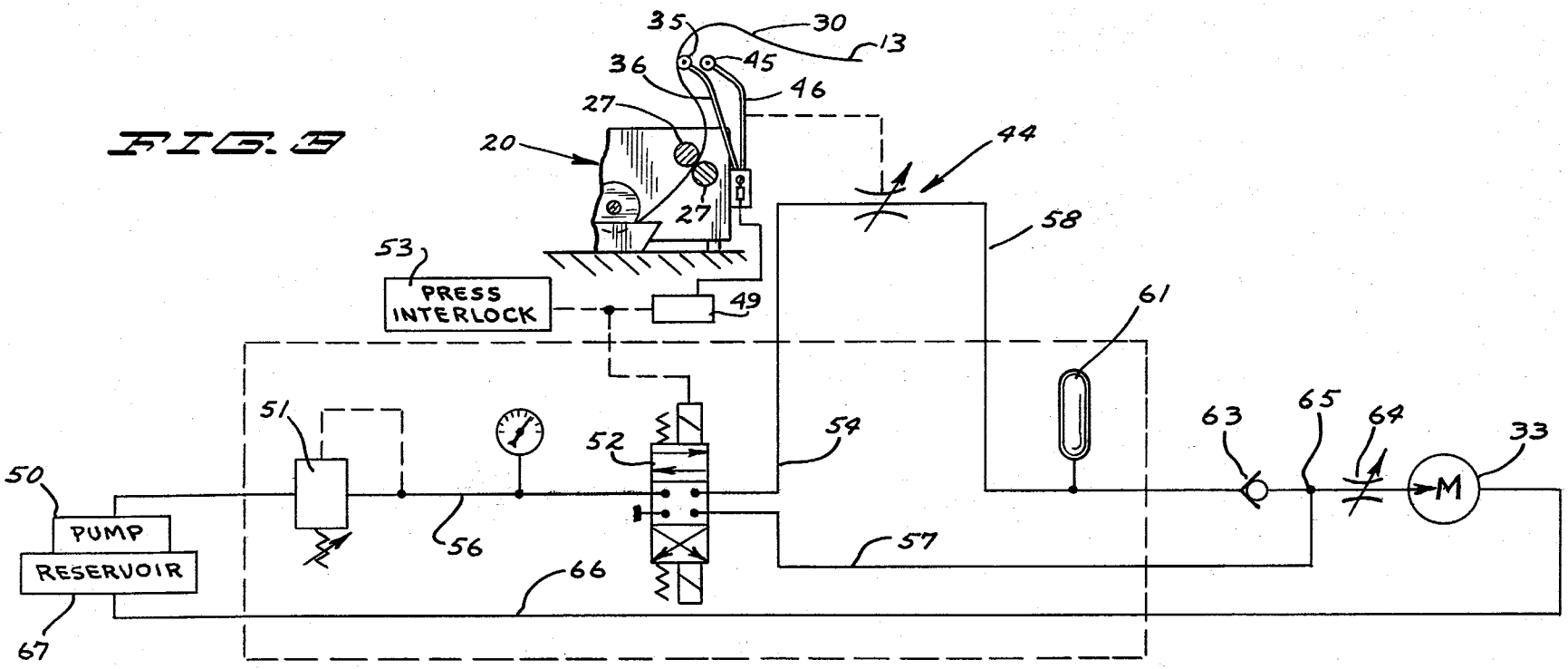
FIG. 3 is a schematic representation of a typical control circuit utilized with the prefeeder to maintain an overhead stock loop within desired limits.

A press indicated schematically at 10, which can be a deep draw press for forming cans from sheet steel, or similar material is provided with an incremental type main feeder 11 which is also schematically shown at the input or infeed side of the press 10. The incremental feeder in the form shown includes a pair of feed rolls 12,12 between which a sheet or strip of material 13 is passed for feeding it into the die portion 31 of the press 10. The rolls 12,12 are intermittently driven in the form of the invention shown by an incremental or intermittent drive 12A, for example the well known "Ferguson" drive. The main feeder 11 is a conventional unit that is commonly used for feeding increments of sheet or strip material into presses. The sheet material in the present form is a steel strip substantially four feet wide, and is quite thin, on the order of 0.010–0.020 inches or so. Thus the sheet steel is quite flexible. The sheet must be fed into the die set of the press in proper increments, at the proper time and must be kept flat and in perfect condition in order to avoid jams in the press 10.

The sheet of material 13 comes from a supply roll 14 that is mounted in a suitable manner on supports 15. The sheet 13 is then first fed into a prefeeder drive, which is indicated generally at 20 and in this form of the invention comprises a lubricator for the sheet of material.

The lubricator or prefeeder 20 includes a housing 21, that has a pair of first guide rolls 22,22 that are spaced so that the will guide the sheet of material into the unit. The rolls 22,22 extend transversely across the width of the lubricator and are sufficiently wide to receive the width of the sheet of material 13.

The sheet 13 then passes between a pair of first drive rolls 23,23 that are also rotatably mounted on the frame or housing 21 and drive the sheet 13 down underneath a retainer guide roll 24 that is also rotatably mounted on the frame. The sheet passes underneath this retainer roll through suitable guides into a pan or receptacle 25 which contains the lubricating liquid 26, such as suitable oil for coating the sheet of material 13 as it passes through the lubricator. The sheet then passes upwardly out of the pan 25, and between a pair of squeegee type rolls 27,27 which are also powered and drive the sheet. Rolls 27,27 are designed to remove excess lubricant from both sides of the sheet 13 so that as it exits from the rolls 27,27, it will have a thin film of lubricant left thereon. As shown, the rolls 27,27 are positioned so that the sheet 13 in inclined upwardly in direction toward the input side of the main feeder 11. The sheet 13 is driven by rollers 27,27 independently of the rollers 12,12 of the main feeder so that before it passes between the rollers 12,12 the sheet forms a loop 30 that is an overhead loop positioned above the plane of the die set 31 in the press 10. The plane is indicated at 32 and is a horizontal plane lying on the feed line to the press. The overhead stock loop 30 thus is above plane 32 so that the inertia of the material that has to be moved when the rollers 12,12 commence their incremental feed is low. The loop 30 can merely bend and open to permit feeding as the material is pushed into the press. There is no need to accelerate and decelerate a large hanging loop between the prefeeder or lubricator drive rolls 27 and the rolls 12,12 of the incremental feeder for the press.

As shown schematically, the rolls 27,27 are driven by a hydraulic motor 33, with suitable drive arrangements such as chain and sprocket. The rolls 23,23 also can be driven from this same motor and are synchronized with the rolls 27,27. For illustrative purposes only, the motor 33 will be considered to be the sole power source for the prefeeder or lubricator.

It can thus be seen that with the motor 33 driving the sheet through the lubricator whenever it is powered and the rolls 12,12 only incrementally feeding the sheet into the die, the size of the loop can change significantly without some control.

Feedback controls are therefore provided for sensing the size of the loop 30 and controlling the motor 33 in response to the feedback signal. An integrator is used in the circuit for motor 33, so that the intermittent motion of the loop, when the rolls 12,12 are operated for the intermittent feed, will not appear as a sudden jerk at the output shaft of motor 33, but rather will be smoothed out.

As shown, a first sensor roller 35 is rotatably mounted on the upper end of an upright arm 36 and is on the inside or underside of the loop 30 of the sheet 13. This arm 36 is drivably mounted on a shaft 37 that is rotatably mounted on suitable bearings 38,38 in a bracket 39 as attached to the output end panel of the housing 21. The shaft 38 is drivably coupled with a suitable coupling 42 to the control shaft 43 of a rotary two way valve 44 that is used as a throttling valve. The valve 44 is a rotary control valve wherein the oil passed through the valve is proportional to the rotation of shaft 43 from an off position.

In addition to the modulating control roller 35, which follows the loop of the sheet as the sheet is moved by rollers 12,12 there is a second control roller 45 mounted onto an arm 46 that in turn is drivably mounted onto a shaft 47. The shaft 47 is also mounted in bracket 39 and has a control lever 48 at the opposite end thereof which controls a switch member 49 that provides an override safety control to shut down the press and lubricator both if the loop 30 gets too small so there is not enough material for another increment feed into the press.

Referring now specifically to FIG. 3, a hydraulic schematic diagram is shown for the drive to the prefeeder, and includes the elements for maintaining the stock loop 30 within its desired limits.

The rolls 27,27 are shown schematically, and the loop 30 is also shwon. In the hydraulic circuit, a pump 50 provides pressure through an adjustable relief valve 51, to a solenoid controlled four way valve 52. This valve 52 may be controlled manually to "jog" the motor 33 and may be used as a shut off controlled by the safety control roller 45. The circuit includes means for turning on valve 52, and as long as the override control is within its range of operation so that the loop is not at its minimum, line 56 will be connected to a line 54. A switch 49 controlled by roller 45 and arm 46 is used as an interrupt switch if the loop 30 gets too small. Line 54 provides hydraulic fluid under pressure to variable valve 44. This valve 44 is shown schematically in FIG. 3, but it is to be remembered that it does have an "off" position when the loop 30 has reached a maximum limit. When the roller 35 and arm 36 have moved to a position where the shaft 37 is rotated a selected distance, the valve 44 is shut off and no further fluid under pressure will pass through this valve 44. Thus valve 44 controls the maximum size of the loop 30.

As will be explained, valve 52 may be moved to position to drive motor 33 and bypass valve 44, but in normal operation the only provision for fluid under pressure to the motor 33 is through the line 54 and valve 44. The output side of the valve 44 has a conduit or line 58 connected thereto, and a hydraulic accumulator 61 is connected to this line. A check valve 63 is connected in line 58 between the accumulator and a needle valve 64 also shown schematically as an adjustable valve (it is manually adjustable). The output of adjustable valve 64 is connected to the input of the motor 33. A conduit 57 is connected as at 65 between the check valve 63 and the needle valve 64. When the valve 52 is in working position with lines 56 and 54 connected, the line 57 is merely blocked off.

The accumulator 61 is set at a relatively low precharge pressure, for example 500 psi. The pressure on line 56 will be maintained at a higher level, for example 1500 psi. As the valve 44 opens, which indicates that loop 30 is smaller than its maximum permitted size, fluid under pressure at this higher pressure will pass into line 58. The needle valve 64 is set to restrict flow so that the pressure in line 58 will be higher than the pressure at the input port to the motor 33. This will cause the accumulator 61 to store some of the fluid under pressure until such time as the needle valve 64 will permit more fluid to pass. The accumulator will provide the stored fluid under pressure to the motor 33 even though the valve 44 may by that time be shut completely off or throttled to a small size.

Assuming that loop 30 is at or near its maximum size, as the main incremental feeder 11 feeds, the loop 30 will be made smaller rather quickly because the feeder 11 feeds as rapidly as possible. The roller 35 will be moved and the arm 36 will rotate shaft 37 which will drive valve 44 to an open position, with valve 52 in its normal on position. Fluid under pressure will be provided through line 54 to line 58 and to the motor 33 driving the rolls 27 to increase the size of the loop. Because the needle valve 64 is in the circuit all of the fluid under pressure passed by valve 44 will not be supplied immediately to the motor 33, but the accumulator 61 will store some of the fluid. Then as the loop increases in size because of motor 33 being driven (and feeder 11 will stop when the proper increment of material has been fed) roller 35 will be permitted to move back toward its original position throttling or closing valve 44. The motor 33 will be driven until the accumulator 61 reaches its rest state, and this will provide a smooth drive to the rolls 27 and may increase the loop size 30 slightly beyond the point where the valve 44 is shut off.

If, however, the loop 30 is not large enough so that when the main feeder 11 starts feeding the loop is made smaller than its minimum size, and the roller 45 is moved beyond its limit, the arm 46 acting on the switch 49 will close (or open) the switch to provide a signal to break the circuit to valve 52. Also this signal may be used to shut off the feeder 11 through an interlock control circuit 53 of desired form.

The feedback signal is integrated (as shown hydraulically) to smooth out the operation of the motor 33 and the rolls 27 so that the rolls are not continuously subjected to widely fluctuating motions. The loop 30 is still maintained at a size to insure proper feeding when the incremental feeder 11 is energized. When properly synchronized the motor 33 will be running substantially all of the time and then loop 30 will be maintained within a fairly narrow range of size. The motor 33 is variable speed, as are most hydraulic motors, and the speed depends upon the input flow. The integrator therefore smooths out what would otherwise be sudden speed variations.

A suitable return line 66 is provied from the motor 33 to a hydraulic reservoir 67.

The motor 33 can be powered independently of the integrator by moving valve 52 by manual switches, for example, to position wherein line 57 is connected to line 56. Fluid under pressure from line 56 will be supplied directly to motor 33 through needle valve 64. Check valve 63 will close to prevent reverse flow through line 58.

The prefeeder drive for the sheet 13 is used to form the overhead stock loop to simplify feeding of material, and the feedback signals are used to control the size range of the stock loop.

The prefeeder drive can be used with any desired type of feeder if desired. The overhead stock loop formed would also be useful for the supply input to a feeder which changed rate of feed but which did not completely stop between feed cycles.

What is claimed is:

1. For use in combination with a hydraulic press and sheet feeder having a feed line, the improvement comprising a lubricator assembly including means for receiving a sheet of material from a coiled supply, means guiding a sheet of material into a lubricating bath, a pair of power roller means for receiving a sheet of material from said lubricating bath and driving such a sheet of material, said power roller means being positioned so that as a sheet of material is received from said lubricating bath and passes through the powered roller means, such a sheet of material is driven in a generally upwardly direction to pass above the feed line of a feeder with which the lubricator is used to form a slack overhead loop of material prior to the entry of such a sheet of material into such a feeder.

2. The combination as specified in claim 1 and hydraulic motor means for driving said power roller means, feedback means for sensing the position of a sheet of material driven by the power roller means at a predetermined location between said powered roller means and a feeder with which the lubricator assembly is used, and control means between said feedback means and said hydraulic motor to control the amount of sheet material that is driven through said lubricator assembly.

3. The combination as specified in claim 2 wherein said control means includes a variable orifice valve responsive in size to the size of said loop, and hydraulic integrator means between said variable orifice valve and said motor.

4. A sheet feeding apparatus for feeding sheet material from a coiled supply of sheet material into a work member along a feed line comprising a lubricator assembly having sheet lubricating means, guide means receiving sheet material from said coiled supply and guiding sheet material to said lubricating means, first sheet drive means on the output side of said lubricating means, power means for said first sheet drive means, and intermittent drive means positioned to drive said sheet subsequent to said first drive means to move the sheet into the work member, said first sheet drive means driving said sheet separately from said intermittent drive means to form a loop in a sheet of material being fed above said feed line between said first drive means and said intermittent drive means, and feedback means sensing the size of said loop and including a control for controlling said power means and said first drive means to drive said sheet material and remove material from the coil of material to regulate the size of said loop.

5. The apparatus of claim 4 wherein said power means is a variable speed power means driving said first drive means as a function of the magnitude of the signal received by the power means, and wherein said feedback means provides a signal to said first power means substantially proportional to the amount of deviation of the size of said loop from a desired size toward a smaller size.

6. The combination as specified in claim 4 and safety shut-off means sensing the size of a loop of material formed and to provide a signal indicating when the loop of material being fed is smaller than a preselected size.

7. A sheet feeding apparatus for feeding sheet material from a coiled supply of sheet material into a work member along a feed line, said apparatus comprising a first sheet drive means, said work member comprising a second sheet drive means that is intermittently operated independently of said first sheet drive means, said first sheet drive means driving sheet material to form a loop in the sheet material being fed prior to entry of the material into said work member, said loop of material being formed above the general line of feeding into said work member, a hydraulic motor for driving said first sheet drive means, feedback means sensing the size of said loop of material including a variable orifice valve controlling flow of fluid to said hydraulic motor through a conduit, and integrator means in the circuit to said motor comprising an accumulator connected in said conduit between said variable orifice valve and said hydraulic motor, and second means forming an orifice in said conduit between said accumulator and said hydraulic motor to integrate the power from the output of said variable orifice valve to smooth out the operation of said hydraulic motor.

8. For use in combination with a press having a first feeder for feeding increments of sheet material into said press at differing rates in a cycle, and having means to support a sheet of material being fed along a feed plane extending across the width of such a sheet, the improvement comprising a separate drive mechanism for a sheet of material between a supply of sheet material and said first feeder including power means to feed sheet material in a direction toward said first feeder and to form a loop of material being fed extending above said feed plane prior to the entrance of sheet material being fed into said first feeder comprising a pair of rotating rollers, a hydraulic motor to drive said rotating rollers, means to sense the size of a loop of material being formed by the drive mechanism, control means responsive to said means to sense and coupled to said hydraulic motor to provide a feedback signal to said power means as a function of the size of a loop of material being formed, including a variable orifice valve to control flow of fluid under pressure to said motor, and hydraulic integrator means between said variable orifice valve and said motor to integrate the flow of fluid under pressure coming from said variable orifice valve.

* * * * *